US006343580B2

(12) United States Patent
Uchida

(10) Patent No.: US 6,343,580 B2
(45) Date of Patent: Feb. 5, 2002

(54) CAM ANGLE SENSOR MOUNTING STRUCTURE FOR ENGINE

(75) Inventor: Masahiro Uchida, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/681,523

(22) Filed: Apr. 23, 2001

(30) Foreign Application Priority Data

May 18, 2000 (JP) ..... 2000-146735

(51) Int. Cl.[7] ..... F01L 1/34

(52) U.S. Cl. ..... 123/90.17; 123/90.31; 123/90.34; 73/116; 73/117.3

(58) Field of Search ..... 123/90.15, 90.16, 123/90.17, 90.31, 90.34; 73/116, 117.2, 117.3

(56) References Cited

U.S. PATENT DOCUMENTS 4,762,097 A * 8/1988 Baker ..... 123/90.31
5,271,360 A * 12/1993 Kano et al. ..... 123/90.17
5,293,776 A 3/1994 Takegami et al. ..... 73/119 R
5,326,321 A 7/1994 Chang ..... 464/2
5,715,780 A * 2/1998 Haller ..... 123/90.17
5,769,044 A * 6/1998 Moriya ..... 123/90.17
6,041,647 A * 3/1999 Matsuoka ..... 73/116
5,924,397 A * 7/1999 Moriya et al. ..... 123/90.18
5,948,973 A * 9/1999 Fujii et al. ..... 73/116
5,979,378 A * 11/1999 Matsuno et al. ..... 123/90.15
5,987,973 A * 11/1999 Fujii et al. ..... 73/116
6,129,061 A * 10/2000 Okuda et al. ..... 123/90.17
6,135,078 A * 10/2000 Doi et al. ..... 123/90.18

FOREIGN PATENT DOCUMENTS

GB 2198853 A 6/1988

* cited by examiner

*Primary Examiner*—Weilun Lo
(74) *Attorney, Agent, or Firm*—Ernest A. Beutler

(57) ABSTRACT

An improved journaling and sensor mounting arrangement for the VVT mechanisms of a twin overhead cam engine. By utilizing a combined single bearing cap for the VVT ends of the camshafts that mounts the sensors that are associated with timing wheels on the respective camshafts, it is possible to maintain a very neat external appearance and a compact construction. Also, high accuracy can be obtained because of the positive rotation of the components. In addition, a simplified oil supply and control arrangement is also disclosed for lubricating the thrust surfaces of the camshaft bearings and other bearing surfaces as well as supplying hydraulic fluid to the VVT mechanisms.

17 Claims, 5 Drawing Sheets

CAM ANGLE SENSOR MOUNTING STRUCTURE FOR ENGINE

BACKGROUND OF INVENTION

This invention relates to four-cycle internal combustion engines and more particularly to an improved variable valve timing control and journalling arrangement for the camshafts of such an engine.

It has been recognized that the performance of an engine can be improved through a wide variety of engine speeds and loads by employing a variable valve timing (VVT) mechanism. In this way, the valve timing can be optimized for the particular running condition so as to provide the desired performance. Generally, the variable valve timing mechanism is interposed in the drive of the camshaft from the engine crankshaft and frequently is mounted on one end of the associated camshaft. When twin overhead camshafts are employed, it is common to have the variable valve timing mechanisms at the same end of the respective camshafts.

In order to perfect the control, it is also necessary or desirable to have a sensor associated with each of the camshafts so as to sense the angular position of the respective camshaft. Various arrangements have been proposed for mounting the camshaft sensor and those methods, which have been proposed, have some disadvantages.

In accordance with one method, the camshafts have a timing wheel or the like mounted at one end thereof, normally the end opposite from the variable valve timing mechanism. A sensor is fixed to the engine body adjacent this timing wheel so as to provide the signal indicative of the camshaft position.

One way in which the sensor may be mounted is by supporting it from the bearing cap for this end of the camshaft. This means that the camshaft is elongated beyond the bearing surface so as to accommodate the mounting of the timing wheel and associated sensor. This presents problems inasmuch as the engine is elongated by such an arrangement.

Another form of sensor for camshaft angle mounts the sensor on the cam cover of the engine. However, this is a rather imprecise way of monitoring the position due to the fact that the cam cover is not always accurately positioned relative to the camshaft or the cylinder head. That is, a sealing gasket is interposed between the cam cover and the cylinder head and this can permit the cam cover and accordingly the sensor to shift relative to the camshaft.

Although keying of the cam cover to the cylinder head can be employed to avoid this problem, this complicates the assembly and nevertheless, there still can be variations in the spacing between the cam cover and the cylinder head even though the axial alignment may be maintained. Also, this keying can generate some engine noise since the silencing of the effect of the gasket is eliminated.

Another way of mounting the sensor is by fastening it directly to the cylinder head itself. However, such mounting may place the sensor in a juxtaposed position to either the intake or the exhaust sides of the cylinder head. This can cause difficulties, particularly undo heating of the sensor if positioned adjacent the exhaust side as generally must be done when the angular position of the exhaust camshaft is being sensed. Also, this can present difficulties in mounting the electrical leads for conveying signals from the sensor to the control for the VVT mechanism.

It is, therefore, a principal object to this invention to provide an improved camshaft sensor arrangement for a four-cycle internal combustion engine wherein the sensor is accurately mounted and does not cause elongation of the engine nor routing problems for the electrical conduits.

It is a further object to this invention to provide an improved and simplified sensor mounting arrangement particularly for multiple camshaft engines wherein each camshaft has a variable valve timing mechanism associated with it.

SUMMARY OF INVENTION

This invention is adapted to be embodied in a four-cycle internal combustion engine having an engine body with a plurality of axially spaced bearing sections. A plurality of axially spaced bearing caps are fixed to the engine body and cooperate with the bearing sections for journaling axially spaced bearing surfaces of a camshaft. A variable valve timing mechanism is associated with one end of the camshaft for driving the camshaft in an adjustable, timed fashion from an engine crankshaft. One of the journalled camshaft bearing surfaces is juxtaposed to the variable valve timing mechanism. A timing member is formed on the camshaft on the side of the one journalled camshaft bearing surface opposite to the variable valve timing mechanism. A timing sensor cooperates with the timing member for providing a signal indicative of camshaft angle. The timing sensor is carried by the bearing cap that journals the one of the journal camshaft bearing surfaces.

DETAILED DESCRIPTION

Figure 1:
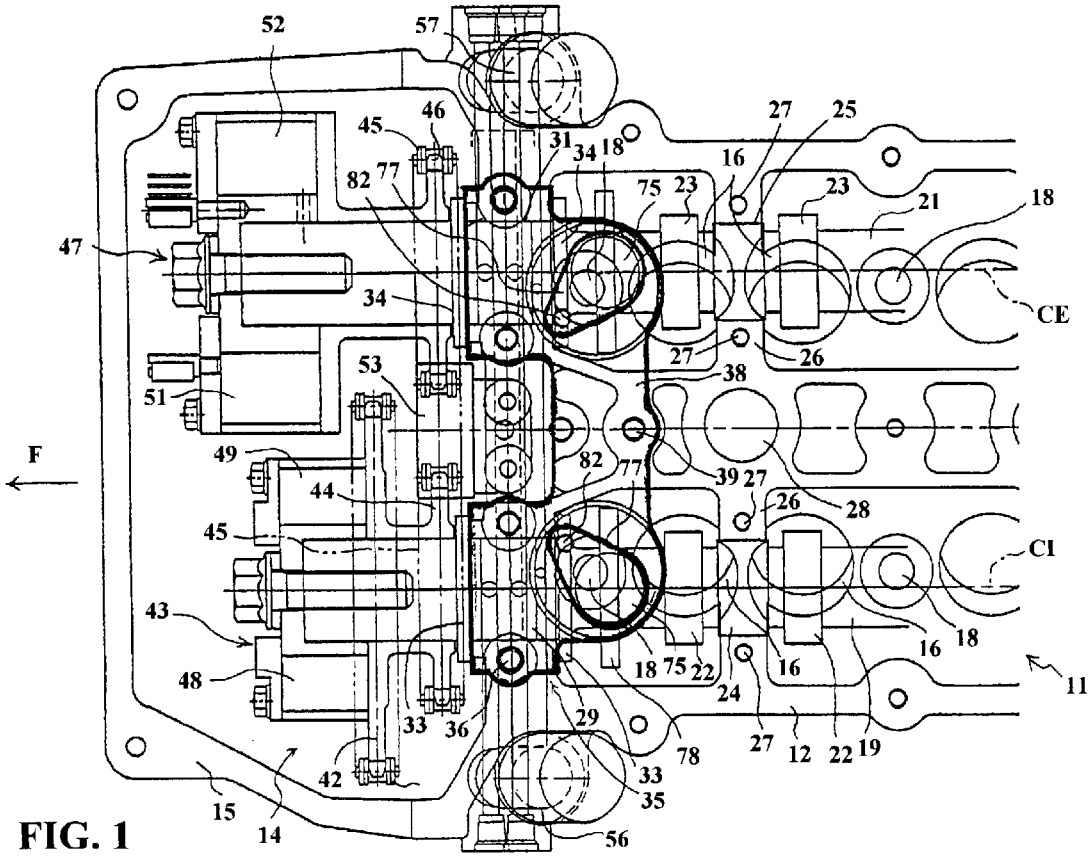
FIG. 1 is a top plan view showing one end of a cylinder head of an internal combustion engine constructed in accordance with an embodiment of the invention, with the cam cover removed, and with portions of the valve actuating mechanism eliminated in order to more clearly show the construction.
Figure 2:
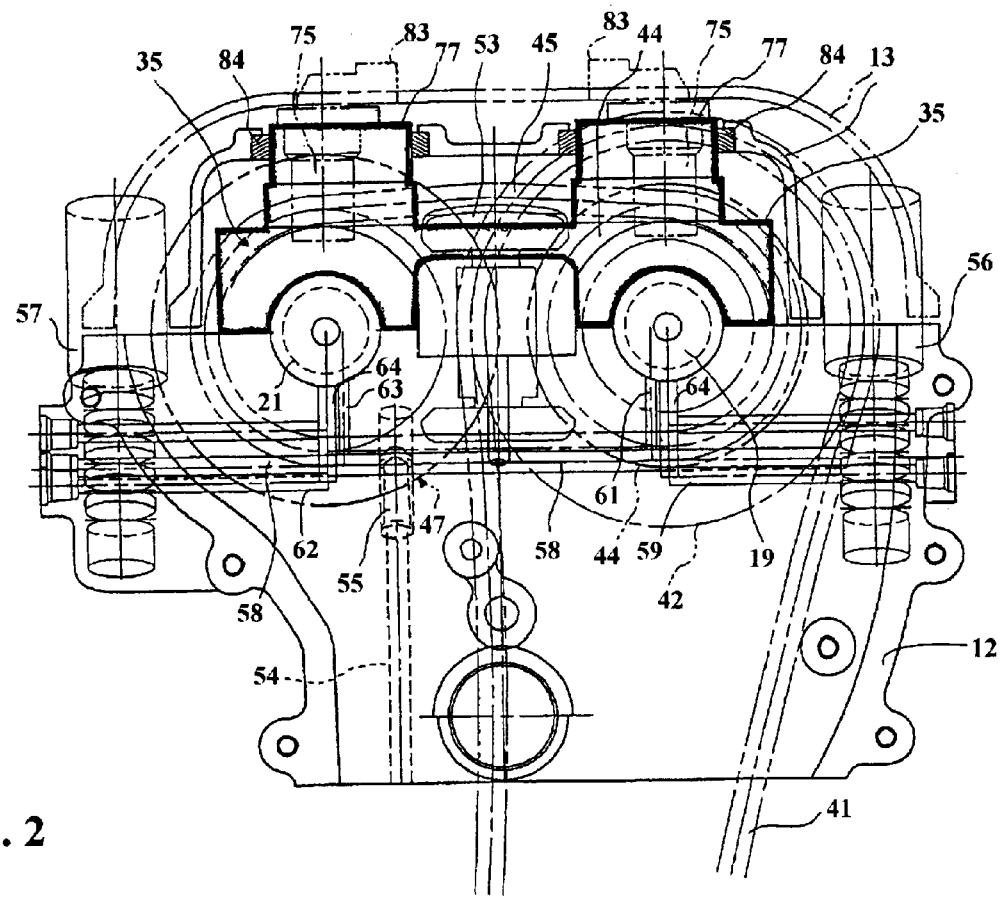
FIG. 2 is a front elevational view of the structure shown in FIG. 1 and illustrates the cam cover in place and shows the control valve mechanism associated with the variable valve timing mechanism.
Figure 3:
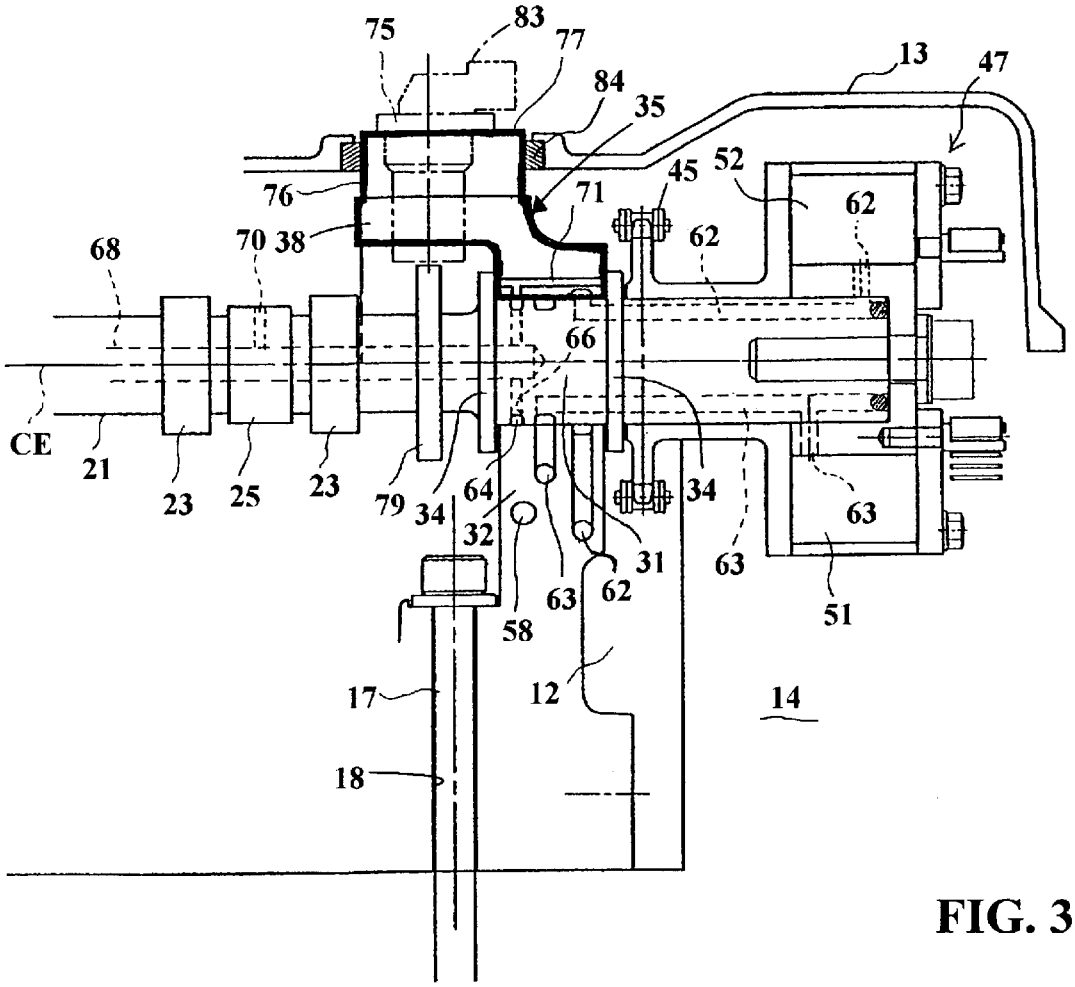
FIG. 3 is a cross sectional view taken through the cylinder head and generally along the axis of one of the camshafts.

Referring now in detail to the drawings and initially primarily to FIGS. 1 through 3, a portion of an internal combustion engine constructed and operated in accordance with the invention is identified generally by the reference numeral 11. Since the invention deals primarily with the camshaft driving and bearing arrangement for the engine 11, only the cylinder head structure of the engine 11 is depicted. This comprises a main cylinder head member 12 to which a cam cover 13 is detachably affixed in a well known manner. A timing case, indicated generally by the reference numeral 14, is formed at the front of the cylinder head member 12 and is closed by a timing case cover 15 at the lower end and by the cam cover 13 at the upper end. This cover 15 also encloses the un-shown front portion of the cylinder block to which the cylinder head member 12 is affixed in the manner to be described.

The main cylinder head member 12 forms a plurality of combustion chambers and, in the illustrated embodiment, each combustion chamber is served by two intake valves and two exhaust valves. These valves are not illustrated in the drawings but the valves are operated by thimble tappets that are received within bores 16 formed in the cylinder head member 12. Since this type of construction is well known in the art, it is not believed necessary to illustrate the valves and their association with the cylinder bores.

However, the cylinder head member 12 is affixed to an associated cylinder block (not shown) by threaded fasteners, one of which is shown in FIG. 3, and which is identified by the reference numeral 17. These threaded fasteners 17 are passed through four fasteners holes 18 formed at the peripheral edges of the associated cylinder head member 12 around each cylinder bore and threaded into tapped openings in the associated cylinder block to affix the cylinder head member 12 to the cylinder block in a manner that is well known in the art.

Journalled in the cylinder head member 12, in a manner to be described, is an intake camshaft 19 and an exhaust camshaft 21. These camshafts 19 and 21 rotate about respective rotational axes Cl and CE. The intake camshaft 19 has individual cam lobes 22 that are associated with the un-shown tappets in the tappet bores 16 on the intake side of the engine. In a like manner, the exhaust camshaft 21 has exhaust lobes 23 that cooperate with the tappets in the tappet bores 16 on the exhaust side of the engine. Again, this type of structure is well known in the art and, for that reason, further details of its construction are not believed to be necessary to understand the construction and operation of the invention.

At axially spaced positions along its length, the intake and exhaust camshafts 19 and 21 are formed with axially spaced bearing surfaces 24 and 25, respectively, that are journalled in bridges 26 formed in the cylinder head member 12 at spaced locations along its length. Individual bearing caps (not shown) are affixed to each of the bridges 26 by threaded fasteners that are received in tapped holes 27 formed between the respective lobes 22 and 23 associated with each cylinder.

A central spark plug well 28 is formed in the cylinder head member 12 at the center of each cylinder bore and receives a spark plug for firing the charge in the combustion chambers in a manner well known in the art.

In addition to the spaced bearing surfaces 24 and 25 of the intake and exhaust camshafts 19 and 21, respectively, each camshaft has an end bearing surface 29 and 31, respectively. These end bearing surfaces 29 and 31 are journalled in an upstanding front end wall 32 of the cylinder head member 12 which is adjacent the timing case 14.

Each camshaft 19 and 21 is formed with a pair of thrust faces 33 and 34, respectively, that are engaged with machined surfaces formed on the cylinder head wall 32 for providing axial location for the intake and exhaust camshafts 19 and 21.

Figure 4:
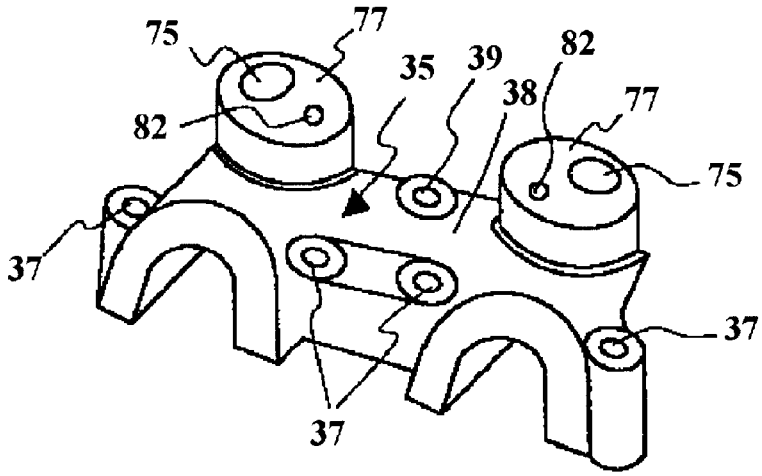
FIG. 4 is a perspective view showing the bearing cap for the driven ends of the camshafts with the timing sensors mounted therein.
Figure 5:
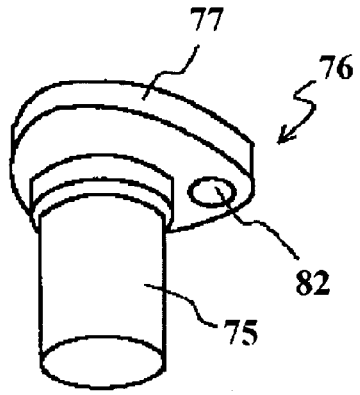
FIG. 5 is a perspective view looking from below showing one of the timing sensors.
Figure 6:
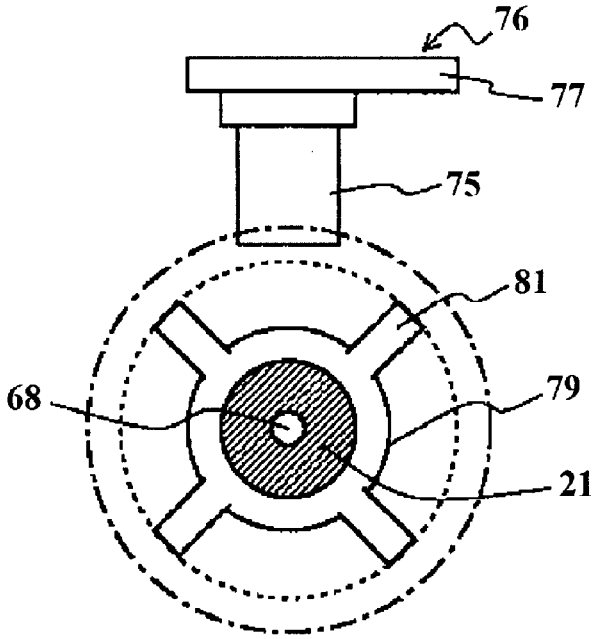
FIG. 6 is a cross sectional view taken generally through the timing sensor and associated timing wheel formed integrally with one of the camshafts.

A unitary bearing cap assembly, indicated generally by the reference numeral 35, is affixed to the cylinder head wall 32 by threaded fasteners 36 that are received in tapped holes formed therein and which pass through openings 37 (FIG. 4) formed in the respective bearing cap portions that cooperate with the respective cylinder head bearing surfaces formed by the wall 32. These bearing portions are joined by a partially cantilevered bridging part 38 of the bearing cap member 35. This bridging part 38 has a further opening 39 to receive a further threaded fastener that engages the cylinder head member 12 to provide rigidity for the cantilevered bridging part 38.

Continuing to refer primarily to FIGS. 1 through 3, the drive for driving the intake and exhaust camshafts 19 and 21, which is contained within the timing case 14 will now be described. A first timing chain 41 is entrained around a suitable sprocket affixed to the crankshaft of the engine and a tensioner pulley. This chain 41 drives a first sprocket part 42 of a two sprocket assembly that is connected to the intake camshaft 19 via a first VVT mechanism 43. This VVT mechanism will be described in more detail later.

Integrally formed with the first sprocket 42 is a second sprocket 44 which, in turn, drives a further timing chain 45 that drives a sprocket 46 that is connected to the exhaust camshaft 21 by a second VVT mechanism, indicated generally by the reference numeral 47. It will be seen that the VVT mechanisms 43 and 47 are staggered relative to each other so as to provide clearance for the timing chain 41 and crankshaft driven timing sprocket 42. This permits a very compact assembly and also accommodates the drive of the camshafts 19 and 21 at one half-crankshaft speed while maintaining a close relationship between the camshaft rotational axes Cl and CE.

A chain tensioner 53 is carried by the cylinder head member 12 and tensions the timing chain 45 that transfers the drive from the intake camshaft 19 to the VVT mechanism 47 for the exhaust camshaft 21.

The VVT mechanisms 43 and 47 may be of any known type and, in the illustrated embodiment, are of the sliding vane type that includes respective pairs of fluid chambers 48 and 49 (VVT 43) and 51 and 52 (VVT 47). These chambers 48 and 49 and 51 and 52 are pressurized selectively, in a manner, which will be described shortly, so as to vary the phase angle between the camshafts 19 and 21 and also between these camshafts and the crankshaft.

Figure 7:
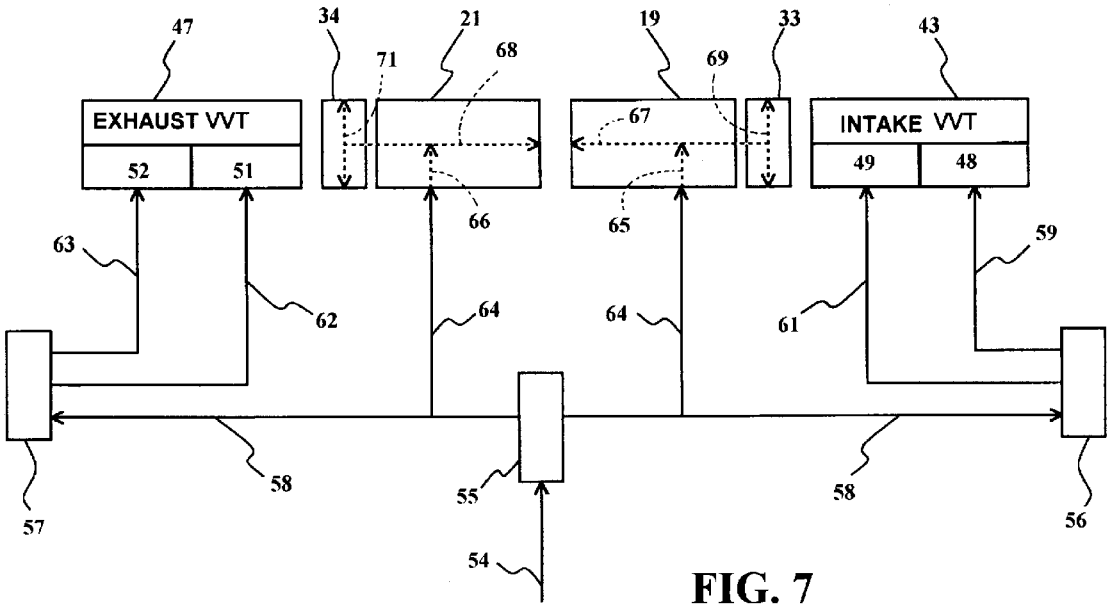
FIG. 7 is a schematic hydraulic diagram showing the lubricating oil passages and control mechanism for the intake and exhaust valve timing mechanisms.

The hydraulic control arrangement for supplying fluid to actuate the VVTs 43 and 47 as well as lubricating the camshaft bearings, will now be described by particular reference to FIGS. 2, 3 and 7 although certain of the components also appear in other figures. As seen in FIG. 2, a main oil gallery 54 is formed in the cylinder head member 12 and cooperates with a corresponding main oil gallery formed in the associated cylinder block. An enlarged bore is formed at the upper end of the oil gallery 54 and receives a replaceable filter element 55 for filtering the oil delivered to solenoid actuated, spool, intake and exhaust timing control valves 56 and 57, respectively.

The main gallery 54 is intersected by a transversely extending gallery 58 that extends across the cylinder head member 12 and which is intersected the spools of the control valves 56 and 57. The solenoid actuated spool valve 56 selectively supplies pressure to the chambers 48 and 49 of the intake VVT mechanism 43 through passages 59 and 61, which are formed in the cylinder head member 12. In a like manner, the chambers 51 and 52 of the exhaust VVT mechanism 47 are selectively supplied with lubricating oil from the solenoid operated control valve 57 through passages 62 and 63, respectively.

This system also provides an arrangement for lubricating the bearings of the intake and exhaust camshafts 19 and 21. The main gallery 58 of the cylinder head member 12 downstream of the filter 55 is intersected by a pair of further supply passages, 64 which communicate with drillings 65 and 66 (FIG. 7) formed in the intake and exhaust camshafts 19 and 21. These drillings intersect longitudinally extending drillings 67 and 68 that are formed in the intake and exhaust camshafts 19 and 21, respectively. The drillings 67 and 68 are intersected by radial drillings 70 formed at each of the bearing surfaces including the bearing surfaces 25 and 31 of the exhaust camshafts as shown in FIG. 3 and like drillings formed in the intake camshaft.

These drillings 67 and 68 also terminate in axially extending drillings 69 and 71, respectively, formed in the bearing cap 35 which terminate at the respective thrust faces 33 and 34 for lubricating these highly loaded surfaces. Thus, the system provides very effective hydraulic supply and lubrication control.

The sensor arrangement for sensing the rotational position of the intake and exhaust camshafts 19 and 21 will now be described by primary reference to FIGS. 1 through 6. It will be seen the cantilevered bridging portion 38 of the front bearing cap 35 is provided with a pair of openings that receive and pass a sensor 75 of a sensor mounting assembly 76. This sensor mounting assembly 76 has a somewhat egg-shaped elongated mounting plate 77 from which the sensor 75 depends and passes into proximity with respective timing wheels 78 and 79 associated with the intake and exhaust camshafts 19 and 21, respectively. These timing wheels 78 and 79 have, in the illustrated embodiment, four individual teeth or lugs 81. As these lugs they pass the respective sensor element 75 it will generate a signal. This may be done either magnetically or through a photosensitive device. The mounting plates 77 are formed with further openings 82 that receive threaded fasteners that are tapped into the cantilevered portion 38 of the bearing cap 35 so as to hold them against rotation. Because these devices extend inwardly, the elongation of the assembly is avoided and a very compact assembly results.

As seen in FIG. 3, the cam cover 13 is provided with an opening through which a portion of the mounting plates 77 and sensor 75 can pass so as to provide an electrical connector 83 which transfers the signals to the control ECU for the variable valve timing mechanisms 43 and 47. An elastic seal 84 is mounted in a groove in the cam cover 13 around its opening so as to sealingly engage the mounting plates 77 of the assembly and thus, provide good sealing while maintaining a simple external electrical connection.

Therefore, from the foregoing description it should be readily apparent to those skilled in the art that the device provides a very compact yet highly effective sensor and lubricating arrangement as well as varying arrangements for the twin overhead camshafts. Of course, the foregoing description is that of a preferred embodiment of the invention and various changes and modifications may be made without departing from the spirit and scope of the invention, as defined by the appended claims.

What is claimed is:

1. An internal combustion engine comprised of an engine body providing a number of axially spaced bearing sections, a plurality of axially spaced bearing caps fixed to said engine body and cooperating with said bearing sections for journalling axially spaced bearing surfaces of a camshaft, a variable valve timing mechanism associated with one end of said camshaft for driving said camshaft in an adjustable, timed fashion from an engine crankshaft, one of said journalled camshaft bearing surfaces being juxtaposed to said variable valve timing mechanism, a timing member formed on said camshaft on the side of said one of said journalled camshaft bearing surfaces opposite to said variable valve timing mechanism, and a timing sensor cooperating with said timing member for providing a signal indicative of camshaft angle, said timing sensor being carried by the bearing cap journalling said one of said journalled camshaft bearing surfaces.

2. An internal combustion engine as set forth in claim 1 wherein the one journalled camshaft bearing surface is located at one end of the camshaft.

3. An internal combustion engine as set forth in claim 1 wherein the engine body is provided with a cover that encloses at least in part the camshaft and the bearing cap journalling said one of said journalled camshaft bearing surfaces and the timing sensor has a portion extending through said cover.

4. An internal combustion engine as set forth in claim 1 wherein the journalled cam shaft bearing surface is bounded by a pair of thrust flanges engaged with the bearing cap journalling the one of said journalled camshaft bearing surfaces for axially locating the camshaft.

5. An internal combustion engine as set forth in claim 4 wherein the variable valve timing mechanism is hydraulically operated.

6. An internal combustion engine as set forth in claim 5 wherein the thrust flanges are lubricated from the same source as operates the variable valve timing mechanism.

7. An internal combustion engine as set forth in claim 6 wherein the lubricant for the thrust flanges is supplied through the bearing cap journalling the one of said journalled camshaft bearing surfaces.

8. An internal combustion engine as set forth in claim 1 wherein there is further provided a second camshaft journalled about an axis parallel to the axis of the first mentioned camshaft by a second number of axially spaced bearing sections of the engine body, a second plurality of axially spaced bearing caps fixed to said engine body and cooperating with said bearing sections for journalling axially spaced bearing surfaces of said second camshaft, a second variable valve timing mechanism associated with one end of said second camshaft for driving said second camshaft in an adjustable, timed fashion from the engine crankshaft, one of said journalled second camshaft bearing surfaces being juxtaposed to said second variable valve timing mechanism, a second timing member formed on said second camshaft on the side of said one of said journalled second camshaft bearing surfaces opposite to said second variable valve timing mechanism, and a second timing sensor cooperating with said second timing member for providing a signal indicative of the camshaft angle of said second camshaft, said second timing sensor being carried by the bearing cap of the second plurality journalling said one of said second journalled camshaft bearing surfaces.

9. An internal combustion engine as set forth in claim 8 wherein the bearing caps carrying the timing sensors comprise a single bearing cap providing bearing surfaces for each of the camshafts.

10. An internal combustion engine as set forth in claim 8 wherein the one journalled camshaft bearing surface of each of the camshafts are located at the same end of both of the camshafts.

11. An internal combustion engine as set forth in claim 8 wherein the engine body is provided with a cover that encloses at least in part the camshafts and the bearing caps journalling said one of said journalled camshaft bearing surfaces and the timing sensors each have a portion extending through said cover.

12. An internal combustion engine as set forth in claim 9 wherein the journalled cam shaft bearing surface of each camshaft is bounded by a pair of thrust flanges engaged with the common bearing cap for axially locating the camshafts.

13. An internal combustion engine as set forth in claim 12 wherein the variable valve timing mechanisms are hydraulically operated.

14. An internal combustion engine as set forth in claim 13 wherein the thrust flanges are lubricated from the same source as operates the variable valve timing mechanisms.

15. An internal combustion engine as set forth in claim 14 wherein the lubricant for the thrust flanges is supplied through the common bearing cap.

16. An internal combustion engine as set forth in claim 9 wherein the timing sensors are mounted on the common bearing cap at the ends of respective elongated mounting plates and lie over the axis of rotation of the associated camshaft.

17. An internal combustion engine as set forth in claim 16 wherein the ends of the elongated plates spaced from the carried timing sensor are connected to the common bearing cap between the axes of rotation of the camshafts.

* * * * *